US010226815B2

(12) United States Patent
Minamiguchi et al.

(10) Patent No.: US 10,226,815 B2
(45) Date of Patent: Mar. 12, 2019

(54) CORE DISCHARGE AND CORE DISCHARGE METHOD

(71) Applicant: Nissan Motor Co., Ltd., Yokohama-shi, Kanagawa (JP)

(72) Inventors: Satoshi Minamiguchi, Kanagawa (JP); Tatsuya Masuta, Kanagawa (JP); Shinichi Tsuchiya, Kanagawa (JP); Masao Azami, Kanagawa (JP); Takeshi Nakano, Kanagawa (JP); Carl Schubeler, Guyancourt (FR); Yuuta Sugiyama, Kanagawa (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 15/577,797

(22) PCT Filed: Jun. 1, 2015

(86) PCT No.: PCT/JP2015/065743

§ 371 (c)(1),
(2) Date: Nov. 29, 2017

(87) PCT Pub. No.: WO2016/194100

PCT Pub. Date: Dec. 8, 2016

(65) Prior Publication Data

US 2018/0161867 A1 Jun. 14, 2018

(51) Int. Cl.

| | |
|---|---|
| ***B22D 29/00*** | (2006.01) |
| ***B22C 1/16*** | (2006.01) |
| ***B22C 1/22*** | (2006.01) |
| ***B22C 9/02*** | (2006.01) |
| ***B22C 15/24*** | (2006.01) |

(Continued)

(52) U.S. Cl.

CPC ..... *B22D 29/003* (2013.01); *B22C 1/167* (2013.01); *B22C 1/22* (2013.01); *B22C 9/02* (2013.01); *B22C 15/24* (2013.01); *B22D 29/006* (2013.01); *B22C 9/12* (2013.01); *B22C 15/02* (2013.01)

(58) Field of Classification Search

CPC .. B22C 1/167; B22C 1/22; B22C 9/02; B22C 9/12; B22C 15/02; B22C 15/24; B22D 29/003; B22D 29/006

See application file for complete search history.

(56) References Cited

U.S. PATENT DOCUMENTS

| | | | |
|---|---|---|---|
| 5,126,089 | A | 6/1992 | Johnson et al. |
| 8,490,677 | B2 | 7/2013 | Zenpo et al. |

(Continued)

FOREIGN PATENT DOCUMENTS

| | | | |
|---|---|---|---|
| CN | 1146385 | A | 4/1997 |
| CN | 1282640 | A | 2/2001 |

(Continued)

*Primary Examiner* — Kevin P Kerns
*Assistant Examiner* — Steven S Ha
(74) *Attorney, Agent, or Firm* — Global IP Counselors, LLP

(57) ABSTRACT

A core discharge device is provided for discharging a sand core from a cast material in which the sand core contains a binder having water glass. The core discharge device includes a humidified gas supply device that supplies humidified gas to the sand core inside the cast molded article. The humidified gas is a gas to which humidity has been added and from which droplets have been removed.

10 Claims, 1 Drawing Sheet

(51) Int. Cl.
*B22C 9/12* (2006.01)
*B22C 15/02* (2006.01)

(56) References Cited

U.S. PATENT DOCUMENTS

| | | | | |
|---|---|---|---|---|
| 8,528,626 | B2 | 9/2013 | Zenpo et al. | |
| 2008/0011443 | A1 | 1/2008 | Crafton et al. | |
| 2015/0047806 | A1* | 2/2015 | Miura | F24D 19/00 165/53 |

FOREIGN PATENT DOCUMENTS

| | | | |
|---|---|---|---|
| CN | 1360528 | A | 7/2002 |
| EP | 1228826 | A1 | 8/2002 |
| JP | 58-137540 | U | 9/1983 |
| JP | 58-179537 | A | 10/1983 |
| JP | 7-314125 | A | 12/1995 |
| JP | 9-174194 | A | 7/1997 |
| JP | 2005-138141 | A | 6/2005 |
| JP | 2015-37798 | A | 2/2015 |
| WO | 2005/023457 | A1 | 3/2005 |

* cited by examiner

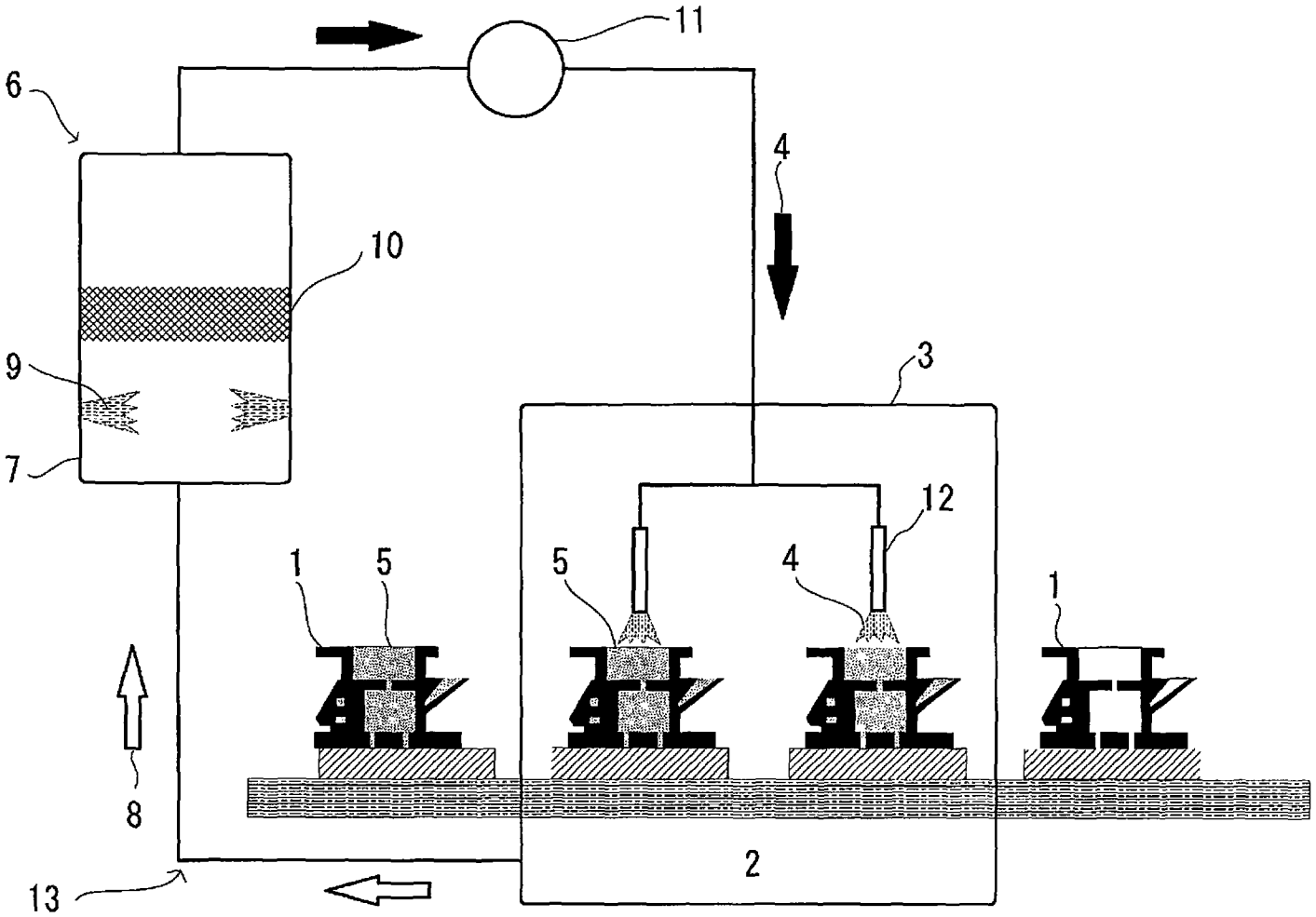
1
1
2
3
4
4
5
5
6
7
8
9
10
11
12
13

CORE DISCHARGE AND CORE DISCHARGE METHOD

CROSS-REFERENCE TO RELATED APPLICATIONS

This application is a U.S. National stage application of International Application No. PCT/JP2015/065743, filed Jun. 1, 2015.

BACKGROUND

Field of the Invention

The present invention relates to a core discharge device and a core discharge method, and more particularly, to a core discharge device and a core discharge method that facilitate the breaking of a core inside a cast material.

Background Information

When casting a hollow article and the like, a sand core formed by hardening a casting sand with a binder is placed in a metal mold and a molten metal is supplied thereto; when the molten metal is solidified, the cast material is removed from the metal mold, and the sand core inside the cast material is destroyed by application of an impact force to carry out discharge.

Examples of binders for hardening the casting sand described above include organic binders that use a phenol resin or the like, and inorganic binders that use water glass.

As described above, in a method in which the sand core is destroyed by application of an impact force to the cast material, the sand core is destroyed and gradually discharged from a sand discharge opening by repeated application of impact force. However, it is necessary to apply at least a predetermined impact force in order to discharge the sand core. In addition, if the density of the casting sand that remains inside the cast material is reduced with the discharge of the casting sand, a void is generated in the cast material and there will be no support from the inside; therefore, if a constant impact force is repeatedly applied, there are cases in which the cast molded article undergoes plastic deformation or is destroyed.

Patent Document 1 (Japanese Laid-Open Patent Application No. Hei 7 (1995)-314125) discloses striking a cast material by a predetermined impact force to destroy the sand core, after which the casting sand is discharged by striking with an impact force that is smaller than the predetermined impact force.

In addition, Patent Document 2 (Japanese Laid-Open Patent Application No. Hei 9 (1997)-174194) discloses destroying the sand core by submerging the sand core, which is formed with a binder containing water glass, in water after casting.

SUMMARY

However, in the technique disclosed in Patent Document 1 described above, if the density of the casting sand that remains inside the cast material is reduced, the impact force that is transmitted to the sand core via the cast material is reduced.

In particular, if the sand core uses an organic binder, the binder is thermally decomposed by the heat during casting and is easily disintegrated in the vicinity of the surface that contacts the molten metal, but the resin will remain inside the sand core, maintaining the strength of the core.

Therefore, it is difficult to completely destroy and carry out discharge to the inside of the sand core by only an impact force, and it becomes necessary to apply heat for decomposing the organic binder in the center of the sand core.

However, if a high temperature is maintained in order to thermally decompose the organic binder, there are cases in which the cast material itself will undergo thermal deformation, particularly in the case of raw material for thin-walled cast molded articles, such as a cylinder head. In addition, if the cast material has a large variation in wall thickness, there are cases in which the temperature difference in the cast material is increased during cooling, generating residual stress and cracks.

Additionally, in the technique disclosed in Patent Document 2, since the cast material is submerged in water, it is difficult to adjust the cooling rate, and in particular, in the case of thin-walled articles, there are cases in which cracks are generated due to residual stress. In addition, the water used for the core discharge treatment becomes strongly alkaline, which necessitates a neutralization treatment, increasing cost.

In view of the problems of the prior art, an object of the present invention is to provide a core discharge device and a core discharge method that facilitate the breaking of the sand core, and with which it is possible to adjust the stress that remains in the cast material to improve the strength of the molded article.

As a result of extensive studies to achieve the object described above, the present inventors found that it is possible to reduce the strength of a sand core by supplying humidified gas, to which humidity has been added, to a sand core formed with a binder containing water glass to achieve the object described above, and thereby completed the present invention.

That is, the core discharge device of the present invention comprises a humidified gas supply device that supplies humidified gas to a sand core containing a binder that contains water glass in a cast molded article.

In addition, the core discharge method of the present invention comprises a humidified gas supplying step for reducing the strength of the sand core by supplying humidified gas to a sand core containing a binder that contains water glass in a cast molded article.

According to the present invention, since humidified gas is supplied to a sand core that is formed by a binder containing water glass, it is possible to easily destroy the sand core, as well as to adjust the cooling rate of the cast material, to suppress the generation of residual stress, and to improve the strength of the cast material by the quenching effect.

BRIEF DESCRIPTION OF THE DRAWINGS

FIG. 1 is a schematic view illustrating one example of the core discharge device according to the present invention.

DETAILED DESCRIPTION OF THE EMBODIMENTS

The core discharge device and the core discharge method of the present invention will be described in detail. The present invention uses a sand core containing a binder, and the binder contains water glass. The water glass described above has a property in which the water glass approaches the properties of inorganic glass and hardens by reducing the content amount of moisture, and decreases in viscosity and flows by increasing the content amount of moisture.

Therefore, a sand core formed by binding with a binder containing water glass has sufficient strength at the time of casting. On the other hand, when discharging from a cast material, the binding force due to water glass can be weakened and the strength of the sand core can be reduced by providing moisture, and the sand core can be destroyed with a weak impact force, or without imparting impact force to the cast material, and easily discharged.

The core discharge device of the present invention is provided with a humidified gas supply device that supplies a highly humidified gas to which humidity has been added, and is made comprising a recovery device for recovering the humidified gas, a striking device, a vibrating device, and the like.

Humidified Gas Supply Device

The humidified gas supply device described above is for supplying humidified gas that is highly humidified by adding humidity thereto to a sand core inside a cast molded article, and comprises a humidifying device, a blowing device, and, if necessary, a droplet removing device, a supply nozzle, and the like.

The humidifying device may be a steam type, in which water is boiled to generate steam, an ultrasonic type, in which water is atomized into fine particles and expelled as is, a hybrid type that combines these two types, or a gas type that passes gas through water or a porous body containing water, but preferably is the ultrasonic type from the standpoint of thermal efficiency.

During casting, it is possible to use waste heat, and to use a high-temperature gas. Therefore, if the humidifying device is of an ultrasonic type, it is possible to add humidity efficiently by making the high-temperature gas come in contact with water mist, and to saturate the water vapor in the humidified gas by cooling the high-temperature gas to a desired temperature with the water mist described above.

The blowing device may be of any type as long as the device is capable of supplying the humidified gas to the sand core, such as a fan type or a blower type, but is preferably a blowing device with a high pressure ratio.

By increasing the air speed of the humidified gas, it is possible to blow away the casting sand whose binding force by the water glass has been weakened, and to allow the humidified gas to reach the interior of the sand core. In addition, it becomes unnecessary to provide a blowing device in a recovery path of a recovery device for recovering the high-temperature gas, thereby preventing a malfunction of the blowing device due to heat.

Additionally, it is preferable for the humidified gas supply device to be equipped with a droplet removing device. With a humidified gas that contains droplets, a liquid film may be formed in the vicinity of the surface of the sand core, and it may become difficult for the humidified gas to reach the inside of the sand core. By removing droplets before supplying the humidified gas to the sand core, the humidified gas permeates the interior of the sand core, and it becomes possible to reduce the strength not only of the surface of the sand core but also of the interior of the sand core, allowing a quick destruction of the sand core.

An example of the droplet removing device is a demister. A demister is made of knit mesh formed of a metal, a resin, or the like. When the humidified gas with fine water droplets passes through a demister, the humidified gas itself will pass through the voids in the knit mesh, but the droplets come in contact with the surface of the mesh wire. Then, due to the capillary phenomenon and the wettability of the wire, the droplets will temporarily remain on the wire, the droplet diameter will gradually increase due to surface tension, and the droplets will fall from the wire by gravity; the droplets are thereby removed.

In addition, the humidified gas supply device preferably comprises a supply nozzle. By supplying humidified gas using the supply nozzle, it becomes possible to adjust the flow rate, flow velocity, direction, pressure, etc., of the humidified gas. Then, self-destruction and removal of the sand core is promoted by directing the supply nozzle toward the sand discharge opening direction of the cast material and supplying humidified gas with a high flow velocity.

Although dependent on the temperature of the humidified gas to be supplied, the amount of moisture contained in the humidified gas that is supplied by the humidified gas supply device is preferably close to the saturated water vapor amount at the temperature at the time of supply, and the relative humidity is preferably 80% or more.

In addition, since there is a limit in the water vapor amount that can be contained in air, and the saturated water vapor amount increases as the temperature is increased, the temperature of the humidified gas is preferably high from the point of view of moisture supply. However, the present invention is used to adjust the cooling rate of the cast material and to quench the cast material; therefore, from the standpoint of balancing these two parameters, the temperature of the humidified gas to be supplied is preferably 40° C.-100° C., and more preferably 60° C.-80° C.

Recovery Device

The recovery device is for recovering humidified gas that has been supplied to the cast material; specifically, the recovery device recovers high-temperature gas that has reached a high temperature by being heated by the cast material and supplies same to the humidified gas supply device. The recovery device comprises a chamber, and piping, or the like, that connects the chamber and the humidifying device.

The chamber mentioned above is for covering a processing booth that supplies humidified gas to the cast material. By covering the processing booth with the chamber and supplying humidified gas, the high-temperature gas that is heated by the cast material is supplied to the humidified gas supply device through the piping mentioned above.

It is possible to saturate the water vapor inside the humidified gas by re-humidifying and cooling the recovered high-temperature gas.

Striking Device

The striking device mentioned above is for destroying the sand core by application of an impact force to the cast material, and an air hammer, or the like, may be used therefor. In the present invention, in addition to the strength of the sand core being reduced by the humidified gas, the cast material is cooled and shrunk by the humidified gas, which compresses the sand core, which becomes easier to destroy. Therefore, in addition to being able to reduce the impact force to be imparted to the cast material, it is possible to reduce the time and frequency of the impact, to prevent deformation/destruction of the cast material due to the impact force, and to reduce the maintenance costs of the striking device.

Vibration Device

The vibration device is for vibrating the cast material and to discharge the destroyed sand core from a sand discharge opening of the cast material, and may be a mechanical type, a hydraulic type, or an electrokinetic type.

The present invention is described in detail below with reference to an embodiment, but the present invention is not limited to the embodiment described below.

A sand core formed by a binder containing water glass is placed in a metal mold, and molten metal is supplied to the metal mold. When the molten metal is solidified, the cast material 1 is removed from the metal mold, and the cast material 1 is placed in a processing booth 2 for discharging the core. The temperature of the cast material at this time is about 350° C.-500° C.

The processing booth 2 is covered by a chamber 3, and humidified gas 4 is supplied to the cast material 1 in the chamber to reduce the strength of the sand core 5, as illustrated in FIG. 1. A plurality of cast materials 1 may be placed in the processing booth 2 and humidified gas 4 may be supplied to a plurality of pieces in parallel. Since there is a limit to the amount of water vapor that can be contained in the humidified gas 4, there are cases in which it takes time until the strength of the sand core 5 is sufficiently reduced, and it is possible to efficiently discharge the sand core 5 by simultaneously processing a plurality of pieces.

The humidified gas 4 described above is generated by the humidifying device 7 of the humidified gas supply device 6. The humidifying device 7 sprays water mist 9 into the supplied high-temperature air 8 to humidify and cool the high-temperature air 8 to 40° C.-100° C. Water droplets of the cooled humidified gas 4 are removed by being passed through the demister 10. Thereafter, kinetic energy is provided by the blowing device 11, and the humidified gas is supplied to the cast material 1 inside the processing booth 2 via the supply nozzle 12.

The humidified gas 4 that is supplied to the cast material 1 reduces the strength of the sand core 5 by supplying moisture, while being heated by the cast material 1. The heated high-temperature air 8 is supplied to the humidifying device 7 of the humidified gas supply device 6 by the recovery device 13 and is re-humidified and supplied to the cast material 1.

The sand core 5 is reduced in strength by being supplied moisture from the humidified gas 4. In addition, since the cast material 1 is cooled to a temperature at which impact force can be imparted, it is possible to quickly impart impact force with a striking device, which is not shown. The destroyed sand core 5 is discharged from the cast material 1 by vibrations generated by a vibration device, which is not shown.

The core discharge device and the core discharge method of the present invention can be favorably used for cast products that are thin-walled and that have complex shapes, such as a cylinder head made of aluminum alloy.

The invention claimed is:

1. A core discharge device for discharging a core from a cast material, the core being a sand core containing a binder that contains water glass, and the core discharge device comprising:

a humidified gas supply device that generates a humidified gas, removes droplets from the humidified gas, and supplies the humidified gas from which the droplets have been removed to the sand core inside a cast molded article.

2. The core discharge device according to claim 1, wherein the humidified gas has a temperature of 40° C.-100° C.

3. The core discharge device according to claim 2, further comprising a recovery device that recovers the humidified gas supplied to the sand core and supplies same to the humidified gas supply device.

4. The core discharge device according to claim 1, further comprising a recovery device that recovers the humidified gas supplied to the sand core and supplies same to the humidified gas supply device.

5. The core discharge device according to claim 1, wherein the humidified gas supply device includes a droplet removing device.

6. The core discharge device according to claim 5, wherein the droplet removing device is a demister.

7. A core discharge method for discharging a core from a cast material, the core being a sand core containing a binder that contains water glass, and the method comprising a humidified gas supply step for supplying humidified gas, to which humidity has been added, to the sand core inside a cast molded article, and a droplet removing step for removing droplets from the humidified gas before supplying the humidified gas.

8. The core discharge method according to claim 7, wherein the humidified gas has a temperature of 40° C.-100° C.

9. The core discharge method according to claim 8, further comprising a recovery step for recovering the humidified gas supplied to the sand core, wherein the recovered humidified gas is used in the humidified gas supplying step.

10. The core discharge method according to claim 7, further comprising a recovery step for recovering the humidified gas supplied to the sand core, wherein the recovered humidified gas is used in the humidified gas supplying step.

* * * * *